US006974157B1

(12) United States Patent
Hammon

(10) Patent No.: US 6,974,157 B1
(45) Date of Patent: Dec. 13, 2005

(54) PRINTED PAMPHLET WITH FOLDED POCKET FOR KEY CARD

(76) Inventor: Robert E. Hammon, 3813 Utah Ter., Wellsville, KS (US) 66092

( * ) Notice: Subject to any disclaimer, the term of this patent is extended or adjusted under 35 U.S.C. 154(b) by 0 days.

(21) Appl. No.: 10/785,814

(22) Filed: Feb. 23, 2004

(51) Int. Cl.[7] ..... B42D 1/00
(52) U.S. Cl. ..... 281/15.1; 281/2; 281/38; 283/61
(58) Field of Search ..... 281/2, 3.1, 5, 15.1, 281/38; 283/61, 62, 63.1, 64

(56) References Cited

U.S. PATENT DOCUMENTS

| | | | | | |
|---|---|---|---|---|---|
| 2,982,322 | A | * | 5/1961 | Seitz | 150/147 |
| 3,655,119 | A | | 4/1972 | Thompson | |
| 3,734,396 | A | * | 5/1973 | Cowan | 229/68.1 |
| 4,488,737 | A | * | 12/1984 | Jacobs et al. | 281/31 |
| 4,534,581 | A | | 8/1985 | Engh | |
| 4,621,729 | A | | 11/1986 | Jackson | |
| 4,850,611 | A | * | 7/1989 | Skelton | 281/5 |
| 5,029,902 | A | | 7/1991 | Komori | |
| 5,141,485 | A | * | 8/1992 | Welt | 493/210 |
| 5,303,956 | A | * | 4/1994 | Zoland | 281/31 |
| 5,487,566 | A | * | 1/1996 | Hedge, Jr. | 283/56 |
| 5,529,172 | A | | 6/1996 | Laughlin | |
| 6,103,332 | A | | 8/2000 | McDonald | |
| 6,382,412 | B1 | | 5/2002 | Wood | |
| 6,572,149 | B2 | | 6/2003 | Long | |
| 2003/0218329 | A1 | | 11/2003 | Buck | |

* cited by examiner

*Primary Examiner*—Monica S. Carter
(74) *Attorney, Agent, or Firm*—Hovey Williams LLP

(57) ABSTRACT

A pamphlet (10) constructed in accordance with the principles of a preferred embodiment of the present invention and configured for receiving and storing a card (12) is disclosed. The illustrated pamphlet (10) broadly includes a single printable blank (14), printed with indicia (16), and folded to form an envelope section (18)—for receiving and securely storing the card (12)—and an adjacent panel section (20) that overlies the card-laden envelope section (18). The card (12) is preferably a key card, such as a hotel or motel room key. The blank (14) is preferably generally rectangular in configuration. The printed indicia (16) preferably includes a map (30) of the city in which the hotel or motel is located. The envelope section (18) is formed without the need for adhesives and is normally closed on three margins (18*a*, 18*b*, and 18*d*) and the fourth margin (18*c*) is closed by folding the panel section (20) into the closed position.

7 Claims, 6 Drawing Sheets

PRINTED PAMPHLET WITH FOLDED POCKET FOR KEY CARD

BACKGROUND OF THE INVENTION

1. Field of the Invention

The present invention relates generally to printed pamphlets. More specifically, the present invention concerns a printed pamphlet that comprises a single blank printed with at least one map that is folded to form an envelope section for receiving and securely storing a motel key card or the like.

2. Discussion of Prior Art

Printed pamphlets are known in the art and are often used to present information to a targeted group of consumers. For example, it is known in the art to print advertising materials (such as food specials, featured entertainment, operating hours, location, etc. of neighborhood commercial establishments) on pamphlets—or brochures—and make those brochures accessible to guests staying at hotels or motels in the vicinity. It is also known in the art to utilize a key jacket to store a room key for a hotel or motel, such as a magnetic key card. These jackets may contain printed indicia relating to the hotel or motel, such as a room number and/or amenity information.

However, these prior art brochures and key jackets are problematic and subject to several undesirable limitations. For example, prior art brochures are not well suited for effectively storing a room key. Prior art key jackets are not well suited for presenting a broad range, or a relatively large quantity, of information. Additionally, these prior art key jackets are undesirably subject to keys inadvertently falling out of the jacket.

SUMMARY OF THE INVENTION

The present invention provides an improved printed pamphlet that does not suffer from the prior art problems and limitations detailed above. The inventive pamphlet includes a folded pocket or envelope—that is sized and configured to receive and store a card, such as a magnetic key card for a hotel or motel room, that enables the card to be quickly accessed yet prevents the card from inadvertently falling out. The folded nature of the envelope enables a relatively large quantity of information to be printed on the pamphlet, such as on various panels prior to folding, yet allows the information to be accessed by simply unfolding the envelope without having to undo any permanent-type joints, such as formed by adhesives or the like. The improved pamphlet, including the folded envelope, can be formed from a single printable blank (such as a rectangular blank of a standard size that could be printed in a conventional desk top printer) without the need for adhesives during formation, thereby enabling a relatively quick, easy, and low cost manufacturing of the simple, yet effective system.

A first aspect of the present invention concerns a pamphlet for storing a card and broadly includes a single printable blank. The blank is generally rectangular in configuration when in a first position wherein the blank is unfolded. The blank includes indicia printed thereon and the indicia includes a map. The blank includes an envelope section when in a second position wherein the blank is folded. The envelope section includes at least three substantially closed sides and is operable to receive at least a portion of the card when the blank is in the second position.

A second aspect of the present invention concerns a pamphlet broadly including an envelope section including at least three substantially closed sides, a panel section adjacent the envelope section and being operable to overlie the envelope section, printed matter received on one or more of the sections and including a map, and a card at least partially received within the envelope section. The sections are formed from a single folded generally rectangular printable blank.

A third aspect of the present invention concerns a method of storing a card and broadly includes the steps of printing indicia on a generally rectangular blank, wherein the indicia includes at least one map, folding the printed blank along at least three fold lines to form an envelope section, and placing at least a portion of a card within the envelope section.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 5:
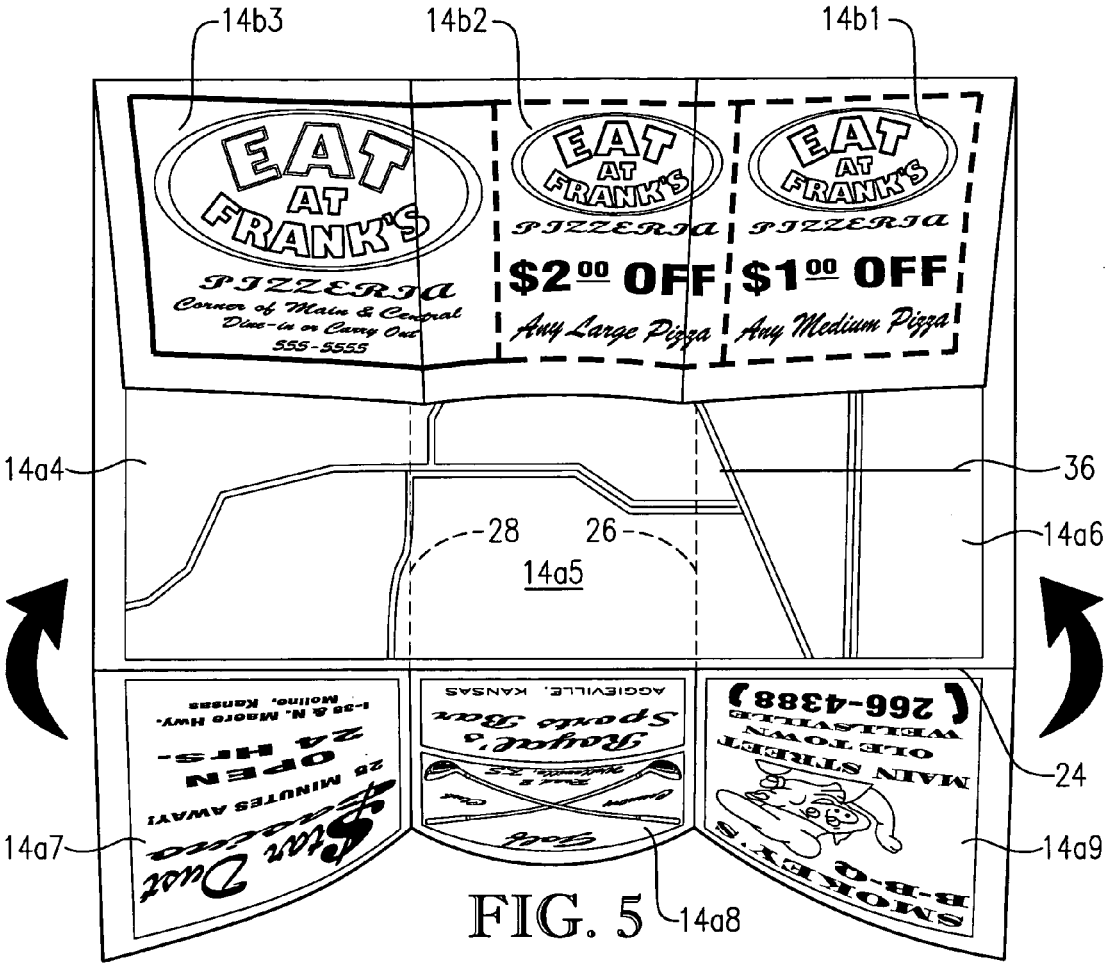
FIG. 5 is a front elevational view of the pamphlet illustrated in FIGS. 1–4 without the key card and shown with the top panel substantially folded into the intermediate position and with the bottom panel partially folded along the second fold line as indicated by the major arrows.
Figure 6:
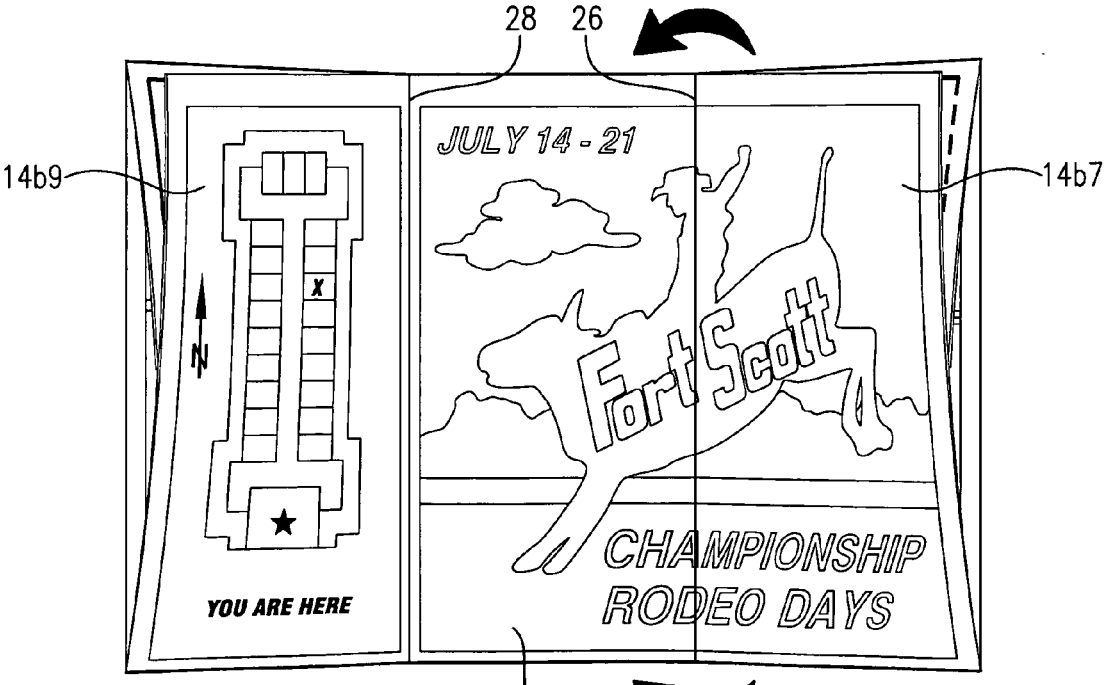
FIG. 6 is a front elevational view of the pamphlet illustrated in FIGS. 1–5 shown without the key card and shown in the intermediate position with the bottom panel substantially folded over the top panel and with the minor arrows indicating the direction of the third fold during assembly.
Figure 7:
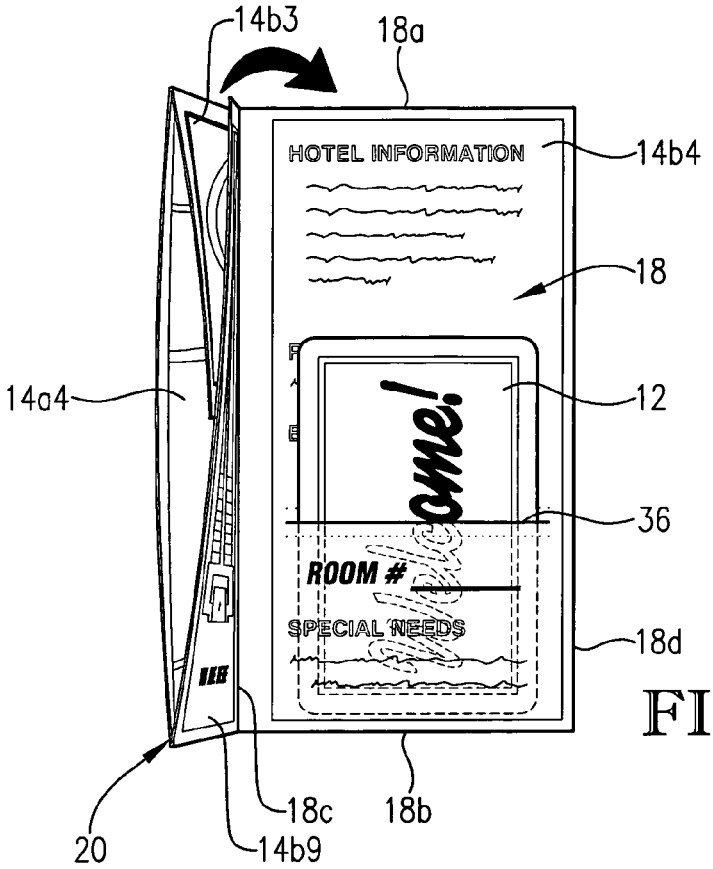
Figure 8:
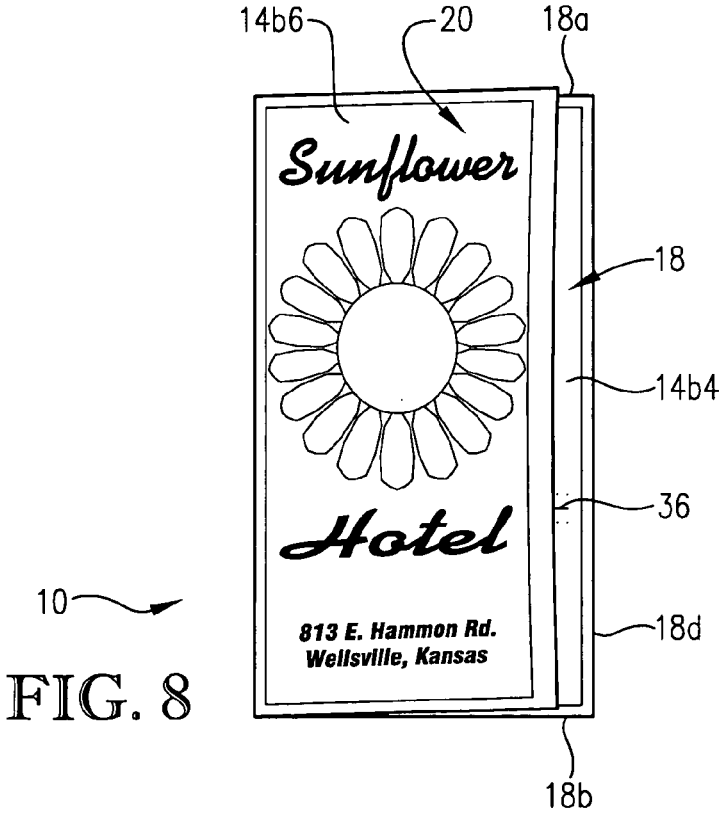

FIG. 7 is a front elevational view of the pamphlet illustrated in FIGS. 1–6 shown with the envelope section fully assembled with the key card received through the slit therein for storage and illustrating the adjacent panel section partially folded along the fourth fold line as indicated by the major arrows; and FIG. 8 is a front elevational view of the pamphlet illustrated in FIGS. 1–7 shown fully assembled with the adjacent panel section folded over the envelope section in the closed position.

DETAILED DESCRIPTION OF THE PREFERRED EMBODIMENTS

Figure 1:
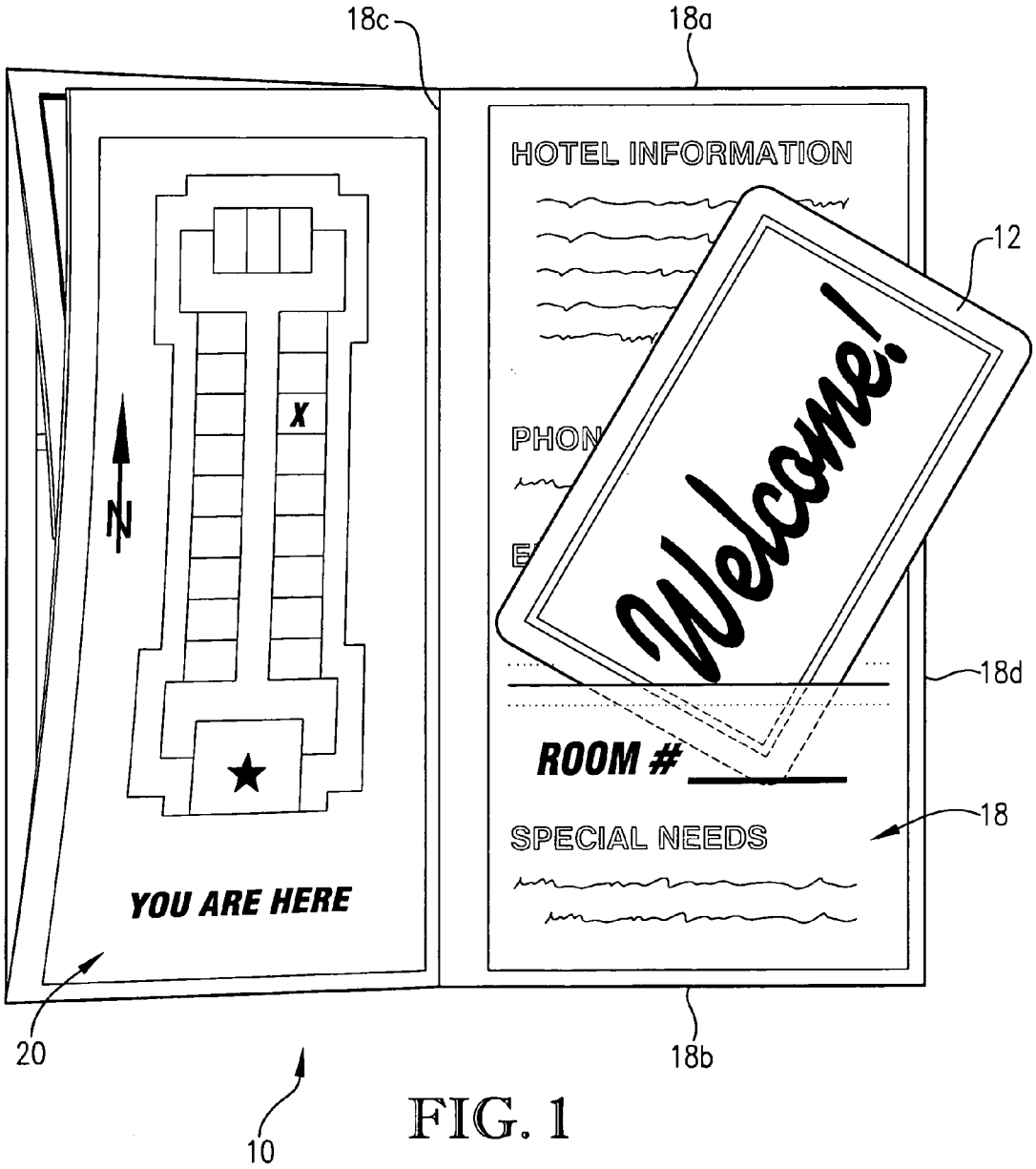
FIG. 1 is a front elevational view of a pamphlet constructed in accordance with a preferred embodiment of the present invention and shown substantially folded, illustrating a key card partially received in a slitted envelope section and with the adjacent panel section shown partially canted toward a fully closed position.

FIG. 1 illustrates a pamphlet 10 constructed in accordance with the principles of a preferred embodiment of the present invention and configured for receiving and storing a card 12. As further described in detail below, the principles of the present invention are particularly well suited for pamphlets that receive and store key cards, such as the magnetic-type that are commonly used as room keys for hotel and/or motel guests. However, the principles of the present invention are not limited to storing magnetic key cards and equally apply to pamphlets that could receive and store virtually any type of removable card, such as business cards and the like. The illustrated pamphlet 10 broadly includes a single printable blank 14, printed with indicia 16, and folded to form an envelope section 18—for receiving and securely storing the card 12—and an adjacent panel section 20 that overlies the card-laden envelope section 18.

Figure 2:
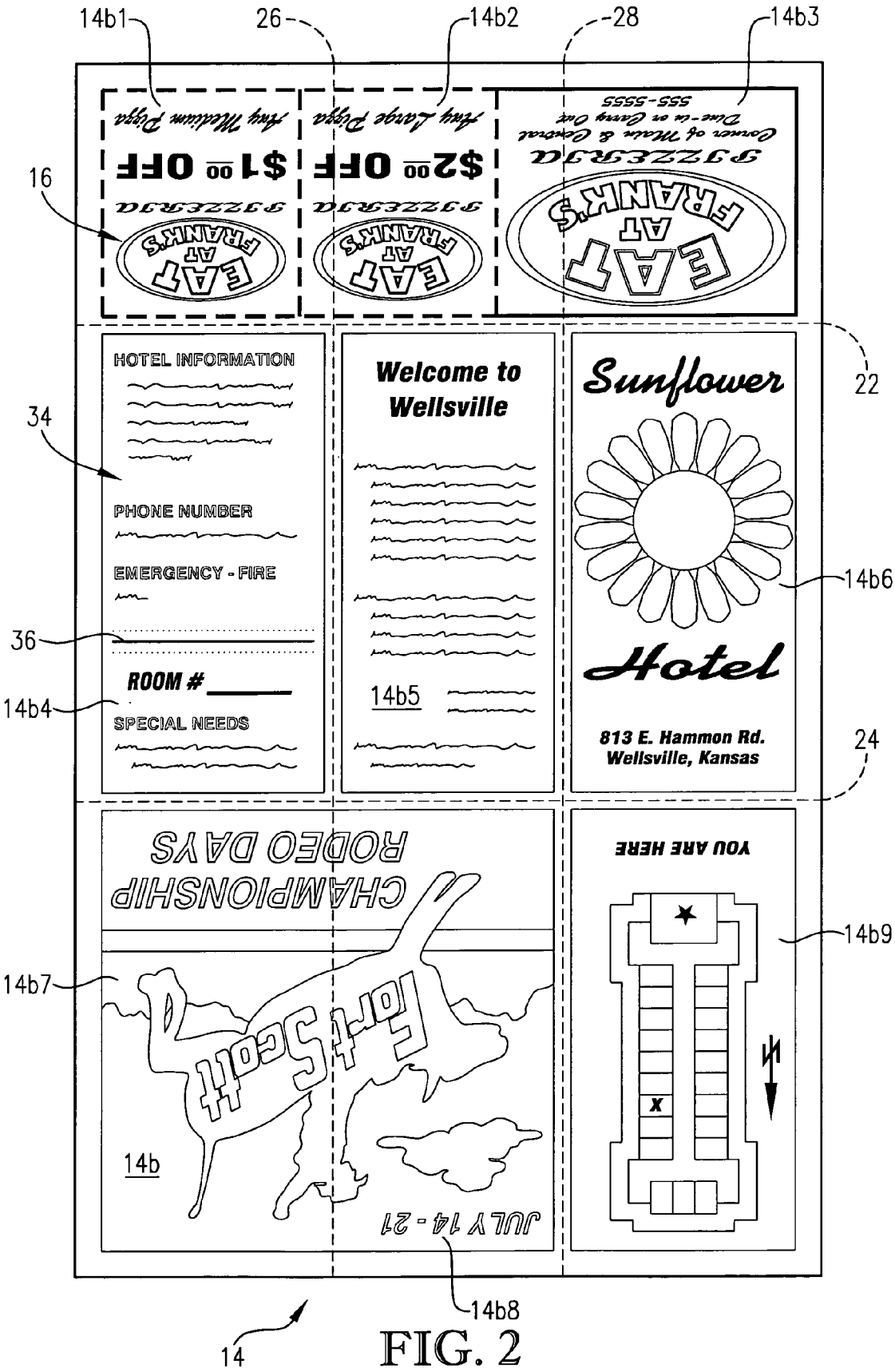
FIG. 2 is a rear elevational view of the pamphlet illustrated in FIG. 1 shown unfolded without the key card to illustrate the fold lines and the printed indicia on the back of the printed blank.
Figure 3:
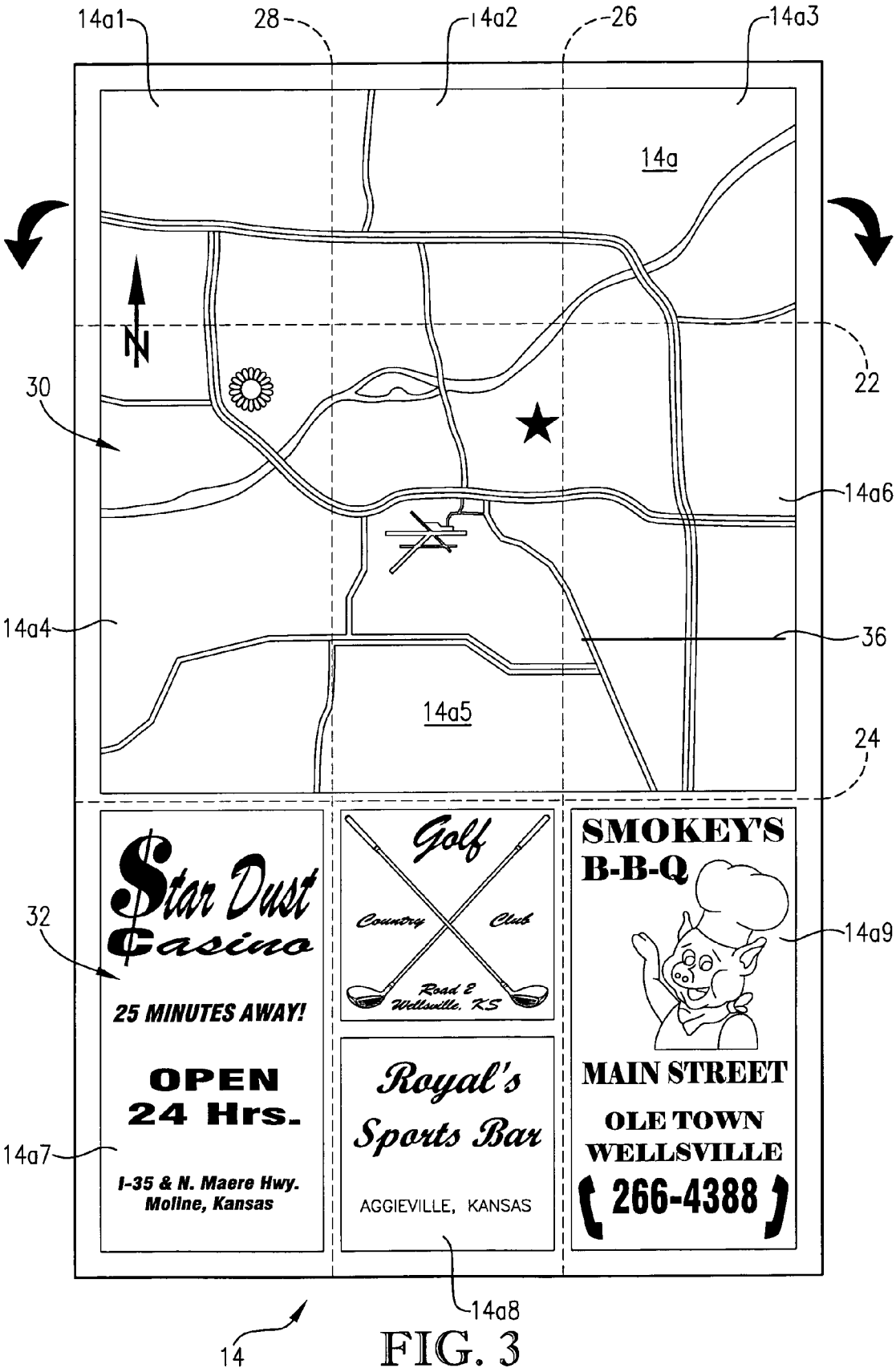
FIG. 3 is a front elevational view of the pamphlet illustrated in FIGS. 1 and 2 shown unfolded without the key card to illustrate the fold lines and the printed indicia on the front of the printed blank, with the minor arrows indicating the direction of the first fold during assembly.
Figure 4:
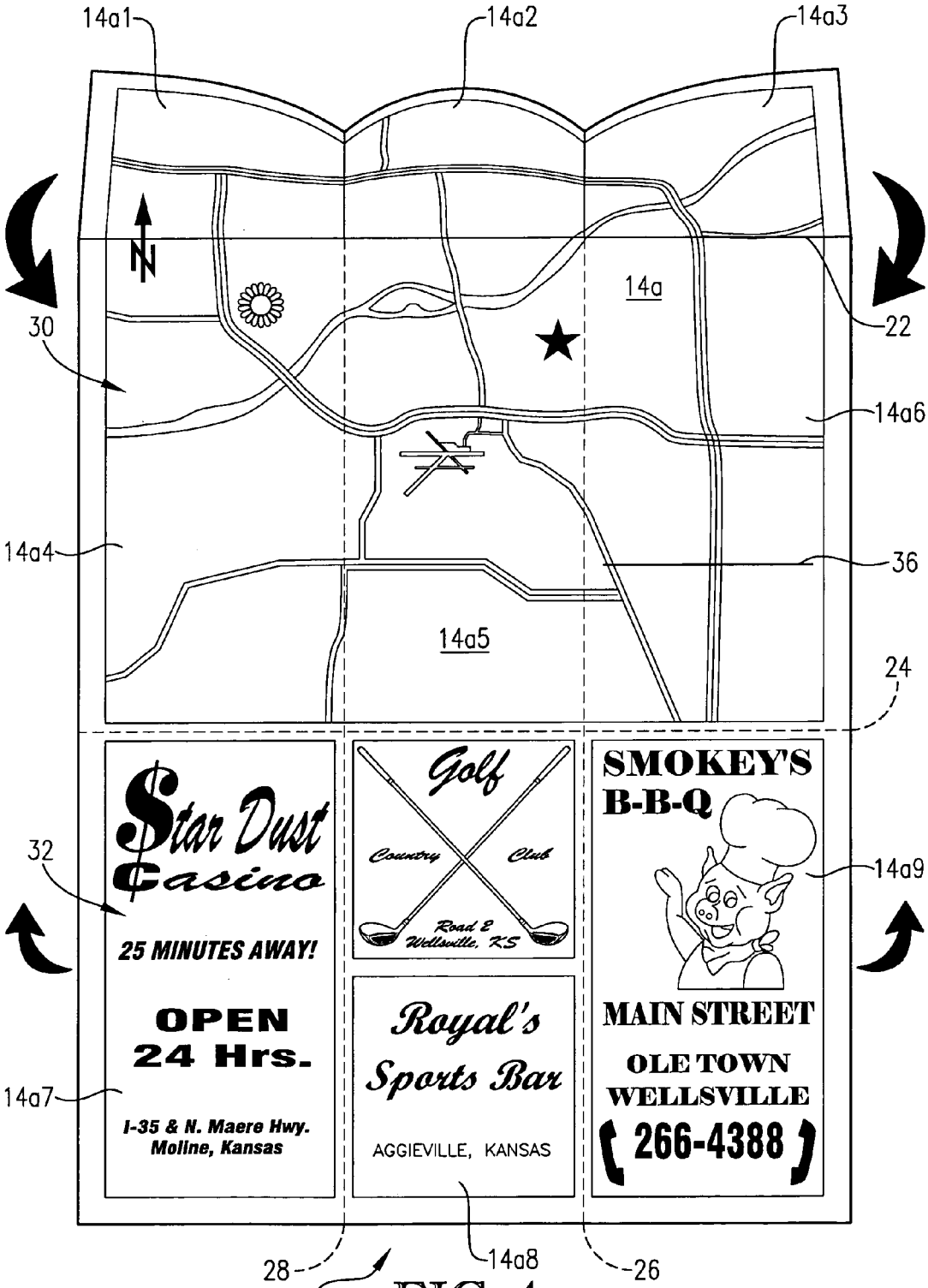
FIG. 4 is a front elevational view of the pamphlet illustrated in FIGS. 1–3 and is similar to FIG. 3, however, the top panel is shown partially folded along the first fold line as indicated by the major arrows with the minor arrows indicating the direction of the second fold during assembly.

As will subsequently be described in detail, the pamphlet 10 begins as the single, generally flat blank 14 as shown in FIGS. 2 and 3, and through a series of chronological folds as shown in FIGS. 3 through 7, ultimately forms the resulting pamphlet 10 for storing the card 12 as shown in FIG. 8. In the subsequent description of the transformation of the flat blank 14 into the assembled pamphlet 10, as well as the use of the assembled pamphlet 10 to store the card 12, a number of different positions will be referenced with respect to the pamphlet in its various stages of formation and use. The prone position, as shown in FIG. 3, refers to the unfolded blank 14 lying generally flat and face up. For reasons that will subsequently become apparent, in use, the pamphlet 10 can easily be returned to the prone position when desired. The intermediate position refers to the blank 14 after it has been partially folded—i.e., after the first two folds have been made as detailed below—and is shown in FIG. 6. The intermediate position is primarily referenced to facilitate the description of the formation of the assembled pamphlet 10. The closed position, as shown in FIG. 8, refers to the assembled pamphlet 10, including the card 12 stored therein, wherein the adjacent panel section 20 is folded to overlie the envelope section 18. In this closed position, the card 12 is securely stored away and the pamphlet 10 is compact for easy carrying, such as in the user's pocket. The access position, as shown in FIG. 1, is temporarily encountered during assembly, but is primarily a position returned to during use of the pamphlet 10 for accessing from and/or restowing the card 12 into the envelope section 18.

Turning now to FIGS. 2 and 3, the pamphlet 10 is formed from the single printable blank 14. In more detail, the illustrated blank 14 is generally flat and formed from printable stock, such as virtually any type of paper. For purposes that will become apparent, it is important that the blank 14 is formed from a material that is sufficiently pliable to enable the blank 14 to be folded into the assembled pamphlet 10 and retain this folded shape. However, it is also important that the material be sufficiently durable that the completed pamphlet 10 can withstand repeated use, including handling by the user, as well as folding and unfolding of the pamphlet 10. In this regard, one suitable material is eighty pound paper stock with an enamel finish, commonly available from several original manufacturers. However, the blank 14 could be formed from other suitable materials, such as synthetic resins and the like. The blank 14 is preferably rectangular in shape when laid out in the prone position as shown in FIG. 3. The rectangular shape enables the blank 14 to be readily folded into the assembled pamphlet 10 with an easy series of simple folds as will be described in detail below. The rectangular shape also desirably maximizes the amount of printable space on the blank 14. The blank 14 is preferably sized and dimensioned to enable the blank 14 to be printed in a conventional desk top printer. The illustrated blank 14 is eight and one-half inches wide by fourteen inches long. However, the blank 14 could be variously dimensioned, including eleven and seventeen inch lengths, as well as other non-standard widths and lengths. However, it is important that when the blank 14 is folded into the assembled pamphlet 10, the pamphlet 10 be sized and configured to store the card 12, yet fit within the user's clothing, such as in a conventional shirt pocket. As indicated above, the blank 14 is preferably sized and dimensioned to enable the blank 14 to be printed in a conventional desk top printer. This enables the pamphlet 10 to be cheaply and efficiently processed in large or small quantities by a producer that may be relatively unskilled in the printing arts, such as a hotel or motel employee and further enables the printed indicia 16 to be quickly and easily altered, updated, and/or modified. However, it is within the ambit of the present invention to print the blanks 14 on a commercial printing press, such as a continuous rotary type press, and sheet the printed stock to any desired size.

Prior to folding the blank 14 into the assembled pamphlet 10, the blank 14 is preferably printed with the printed indicia 16 on the front and back faces of the blank 14 in a configuration that enables certain aspects of the printed indicia 16 to be read after the pamphlet 10 is folded into its assembled format. Particularly, the illustrated printed indicia 16 is spread out over eighteen panels on the blank 14; nine panels **14*a*1–14*a*9 arranged on the front face 14*a* of the blank 14 (as shown in FIG. 3), and nine panels 14*b*1–14*b*9 on the rear face 14*b* of the blank 14 (as shown in FIG. 2). As will be subsequently described in detail, four fold lines, represented by the dashed lines 22, 24, 26, and 28 in FIGS. 2–5, are formed in the blank 14 during formation of the assembled pamphlet 10. The printed indicia 16 is arranged on the panels 14*a*1–14*a*9 and 14*b*1–14*b*9 according to the relationship of the respective panel to one or more of the fold lines 22–28. In this manner, when the blank 14 is folded into the assembled pamphlet 10 and the pamphlet 10 is in the access position, certain portions of the printed indicia 16 are visible—and readable—on the envelope and adjacent panel sections 18 and 20**, respectively.

The printed indicia 16 preferably directly relates to the specific application of use of the assembled pamphlet 10. For example, the illustrated pamphlet 10 is configured to receive and store hotel room keys, such as the key card 12, therefore, the printed indicia 16 is all targeted to the typical hotel guest. In this regard, the illustrated printed indicia 16 includes a map 30, a plurality of advertisements 32, and facility information 34. In more detail, the map 30 is printed on the front face **14*a* of the blank 14 and spans the panels 14*a*1–14*a*6. The map 30 is preferably a city map of the city in which the hotel is located. To facilitate the level of detail contained in the map 30, the map 30 preferably spans several panels on the blank 14. Additionally, the map 30 is preferably located on the front face 14*a* of the blank 14. In this regard, the map 30 is not visible by the user when the pamphlet 10 is assembled. However, as detailed below, the assembled pamphlet 10 can be quickly and easily unfolded into the prone position to reveal the map 30. Placing the map 30 on the front face 14*a* of the blank 14 enables the other panels on the back face 14*b* that are viewable by the user when the pamphlet 10 is assembled, and in the access position, to be reserved for indicia 16 that is desirably more easy to access by the user, such as the advertisements 32 and the facility information 34. For example, the illustrated key card 12 does not contain the user's room number, therefore, this room number is preferably placed conspicuously on the panel 14*b*4 below the slit 36. While it is important that the printed indicia 16 include at least one map, the map need not be a city map, and could for example, be visual directions to a particular business or the like. For purposes that will subsequently be described, the panel 14*a*6, over which a portion of the map 30 spans, includes a card-receiving slit 36, as shown in FIG. 3**.

In the illustrated pamphlet 10, the advertisements 32 are printed on both the front and back faces **14*a*, 14*b* of the blank 14 and are included on the panels 14*a*7–14*a*9 on the front face 14***a*, and on the panels 14*b*1–14*b*3 and 14*b*7–14*b*8 on the rear face 14*b*. The illustrated advertisements 32 preferably promote activities and businesses appealing to the typical hotel guest, such as restaurants in the surrounding area. In this manner, advertisements could be sold to generate revenue to cover the costs of making the pamphlet 10. For example, if the pamphlet 10 is produced by a third party unaffiliated with the hotel, the advertisement revenue may enable the pamphlet 10 to be provided at no charge to the hotel. The advertising 32 could be variously configured and alternatively arranged. The number of advertisements 32 could be increased by simply dividing the panels into smaller sections, such as shown in the panel 14*a*8. In the illustrated pamphlet 10, the panels 14*b*4–14*b*7 are preferably reserved for facility information 34 related to the hotel, however, these panels could also be used for advertising, particularly if these conspicuously located panels garner a higher per ad revenue.

In the illustrated pamphlet 10, the facility information 34 is printed on only the rear face 14*b* of the blank 14 and is included on the panels 14*b*4–14*b*6 and 14*b*9. When the pamphlet 10 is assembled, it will be appreciated that the panels 14*b*4–14*b*7 are particularly conspicuous. Accordingly, these panels are preferably reserved for information that the targeted user desires to quickly and easily access—e.g., without the need to unfold the assembled pamphlet 10. Because the illustrated pamphlet 10 the illustrated pamphlet 10 is configured to receive and store hotel room keys, such as the key card 12, the facility information 34 is preferably placed on one or more of the panels 14*b*4–14*b*7. The illustrated facility information 34 includes information important to the typical hotel guest, such as their room number, a map of the hotel facilities, amenities and services offered by the hotel. As previously indicated, the blank 14 includes the card-receiving slit 36 formed through the panels 14*a*6 and 14*b*4. For purposes that will subsequently become apparent, in the illustrated pamphlet 10, the room number is preferably positioned adjacent and below the slit 36 (see FIGS. 1 and 2). When the pamphlet 10 is assembled and in the closed position, as shown in FIG. 8, the panel 14*b*6 is positioned on the front of the pamphlet 10—i.e., on the front face of the section 20. Accordingly, in the illustrated pamphlet 10, the panel 14*b*6 includes the name and identifying information of the hotel. It will be appreciated that the pamphlet 10 enables a wide variety of relevant information to be presented to a targeted group of consumers in a single pamphlet. However, the nature of the information presented will vary depending on the application and thus the targeted group of consumers. While some printed indicia is important, the indicia could be virtually any combination of information arranged in any suitable way. As indicated above, the pamphlet 10 could be printed in a desk top printer, such as by the hotel employees, and the printed indicia 16 could be updated or altered periodically. For example, the map of the hotel facilities could include an X marking the user's room location that correspond's to the user's room number.

As previously indicated, the blank 14 is assembled into the pamphlet 10 having the envelope section 18 and the adjacent panel section 20 through a series of folds. In more detail, and as shown in FIGS. 3 through 8, there are only four folds required to assemble the illustrated pamphlet 10 into the closed position as shown in FIG. 8. These four folds are performed in sequence and correspond to the fold lines 22–28. Particularly, the first fold, as shown in FIGS. 3–5, includes folding the top portion of the blank 14 over and along the first laterally extending fold line 22 so that ultimately the panels 14*a*1–14*a*3 engage the a portion of the panels 14*a*4–14*a*6. Once the first fold has been completed, the second fold, as shown in FIGS. 4–6, includes folding the bottom portion of the blank 14 over and along the second, lower laterally extending fold line 24 until the partially folded blank 14 is in the intermediate position as shown in FIG. 6. In the intermediate position, a portion of the panels 14*a*7–14*a*9 engage a portion of the corresponding panels 14*b*3, 14*b*2, and 14*b*1, respectively. It is noted that in the illustrated pamphlet 10, the fold lines 22 and 24 are not equally spaced from the top and bottom margins of the blank 14, respectively. That is to say, the illustrated blank 14 is not folded laterally into thirds. However, if an alternatively dimensioned blank is utilized, such as a seventeen inch long blank, the blank is preferably laterally folded into thirds to form the intermediate position.

Once the lateral folds—i.e., the first and second folds—have been completed and the blank 14 is in the intermediate position, the third fold can be performed. From the intermediate position, and as shown in FIGS. 6–7, the third fold includes folding the right side of the blank 14 over and along the third fold line 26—i.e., the far right vertically extending fold line 26—until the panel 14*b*7 at least partially engages the panel 14*b*8. Once the third fold has been completed, the pamphlet 10 is now in the access position as shown in FIG. 1 and the envelope section 18 and the adjacent panel section 20 are fully formed. As further detailed below, once the envelope section 18 has been fully formed, the card 12 can be received therein and thus the pamphlet 10 is operable for use. Once the card 12 has been received in the envelope section 18, the fourth fold can be performed. As shown in FIGS. 7–8, the fourth fold includes folding the adjacent panel section 20 over and along the vertically extending fourth fold line 28 until the section 20 substantially overlies the envelope section 18. That is to say, the pamphlet 10 can be folded from the access position as shown in FIG. 1 into the closed position as shown in FIG. 8. Once in the closed position, the pamphlet 10 securely stores the card 12 therein in a compact single unit that can be conveniently stowed on the user, such as in a pocket of the user's clothing.

Returning now to FIGS. 1 and 7, the envelope section 18 is sized and configured to receive and store the card 12. In more detail, the illustrated envelope section 18 is defined by four outer margins, two opposed lateral margins 18*a* and 18*b*, and two opposed vertical margins 18*c* and 18*d*. The lateral margins 18*a*, 18*b* and the vertical margin 18*d* are closed so that the envelope section 18 is closed on three sides when the pamphlet 10 is in the access position. In the illustrated pamphlet 10, the top margin 18*a* is formed by folding the top portion of the blank 14 along the first fold line 22. It will be appreciated that when this fold generally prevents the card 12 from sliding out of the top of the envelope section 18, particularly when the bottom portion of the blank 14 is pressed firmly there against—such as when the user has the pamphlet 10 pressed in a pocket. However, the top margin 18*a* is not completely closed in the sense that the card 12 could slide over the folded top portion and under the bottom portion of the blank 14, but rather is substantially closed. It is within the ambit of the present invention to first fold the blank 14 along the second fold line 24 and then fold the top portion of the blank 14 down over the bottom portion to completely close the top margin 18*a*. In this regard, the envelope section 18 forms a pocket for receiving and securely storing the card 12. This closed pocket configuration is advantageous in that even were the card 12 to pass entirely through the slit 36 into the inside of the envelope section 18, the card 12 could not inadvertently fall out of the envelope section 18. As indicated below, although the slit 36 is preferred to enable a portion of the card 12 to extend out of the envelope section 18, alternatively, when the pamphlet 10 is in the access position, the card 12 could alternatively be slid entirely within the envelope section 18 for storage—such as via the open vertical margin 18*c*. It will further be appreciated that when the adjacent panel section 20 is folded into the closed position overlying the envelope section 18, the fourth margin—the vertical margin 18*c*—becomes closed. Therefore, the card 12 is securely stored and cannot inadvertently fall out and be lost. It will further be appreciated that the envelope section 18 is formed without the use of any adhesives, such as glue or the like. In this manner, the pamphlet 10 can be easily returned to the prone position, such as for viewing the city map 30. Moreover, the lack of adhesives enables the pamphlet 10 to be formed in a cost-effective and efficient manner.

The envelope section 18 includes the slit 36 in communication therewith. The slit 36 is presented when the pamphlet 10 is in the access position. The slit 36 is sized and configured to receive the card 12 there through so that at least a portion of the card 12 is received inside the envelope section 18 (see FIG. 7). Preferably at least about one-third of the card 12 protrudes out of the envelope section 18 to enable the card 12 to be grasped by the user for quick and easy access when desired. As previously indicated, the illustrated card 12 is a magnetic-type hotel room key card, as are commonly known in the art. It will be appreciated that such cards are conventionally about two inches in width and about three inches in length. Accordingly, the illustrated slit 36 is preferably between two and two and one-half inches in length and most preferably about two and one-quarter inches long. It is important that the slit 36 does not extend beyond either of the vertical margins 18*c*, 18*d* of the envelope section 18. However, it will also be appreciated, that given the preferred eight and one-half inch width of the illustrated blank 14, when the pamphlet 10 is in the closed position—that is folded generally into thirds width wise—the pamphlet 10 is preferably less than three inches in width. These relatively tight tolerances are preferred in that when the pamphlet 10 is in the closed position, the pamphlet 10 is preferably sized and dimensioned to be received in a standard shirt pocket or standard pant pocket. It is within the ambit of the present invention to utilize an envelope section 18 that does not utilize a slit 36. For example, the card 12 could simply be slid into the envelope section 18 through the open margin 18*c* when the pamphlet 10 is in the access position.

Once assembled, the pamphlet 10 is ready for use. In operation, when a user, such as a hotel guest, checks into the hotel, a supply of pamphlets 10 without the cards 12 can be inventoried at the registration counter. Once the magnetic key card 12 has been activated with the appropriate room code, the card 12 can be placed in one of the pamphlets 10 and given to the guest. Particularly, the pamphlet 10 can be placed in the access position, a portion of the card 12 can be slid through the slit 36 into the envelope section 18, and the adjacent panel section 20 can be folded over the card-laden envelope section 18 into the closed position. To access their key card 12, the user simply opens the pamphlet 10 into the access position and removes the card 12. Should the user desire to view the city map 30, the user simply unfolds the pamphlet 10 into the prone position. The unique pamphlet 10 provides the user with all the necessary relevant information that the user may need while staying as a guest in the hotel in one easy to carry item that also generally prevents inadvertent loss of guests room key. Although the pamphlet 10 is particularly well suited for hotel and motel applications, it is within the ambit of the present invention to utilize various alternative configurations for the inventive pamphlet and the principles thereof are not limited to pamphlets for storing and receiving key cards. For example, the pamphlet could be configured to receive and store business cards and the like.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A pamphlet for storing a card, said pamphlet comprising:

a single printable blank, said blank being generally rectangular in configuration when in a first position wherein the blank is unfolded, said blank including indicia printed thereon, said indicia including a map, said blank including an envelope section when in a second position wherein the blank is folded, said envelope section including at least three substantially closed sides and being operable to receive at least a portion of the card when the blank is in the second position, said blank further including a panel section adjacent said envelope section when the blank is in the second position, said envelope section including a fourth side that is normally open when the blank is in the second position, said panel section cooperating with the envelope section to generally close the fourth side of the envelope section when the blank is in a third position wherein the panel section generally overlies the envelope section said sides of said envelope section being closed when the blank is in the third position entirely by folds formed in the blank without the use of adhesives.

2. The pamphlet as claimed in claim 1, said envelope section including a slit formed therein operable to receive the at least a portion of the card therethrough.

3. The pamphlet as claimed in claim 1, said map being visible when the blank is in the first position, said map being generally not visible when the blank is in the second position.

4. The pamphlet as claimed in claim 3, said blank presenting opposed front and rear faces, said map spanning more than half of the front face.

5. The pamphlet as claimed in claim 1, said blank being convertible between the first and second positions by folding the blank along first, second, and third fold lines.

6. The pamphlet as claimed in claim 5, said first and second fold lines being generally parallel to each other.

7. The pamphlet as claimed in claim 6, said third fold line being generally perpendicular to said first and second fold lines.

* * * * *